US009646549B2

(12) United States Patent
Chen

(10) Patent No.: US 9,646,549 B2
(45) Date of Patent: May 9, 2017

(54) LIQUID CRYSTAL DEVICE AND THE DRIVING METHOD THEREOF

(71) Applicant: Shenzhen China Star Optoelectronics Technology Co., Ltd., Shenzhen, Guangdong (CN)

(72) Inventor: Lixuan Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 308 days.

(21) Appl. No.: 14/385,994

(22) PCT Filed: Jul. 25, 2014

(86) PCT No.: PCT/CN2014/083019
§ 371 (c)(1),
(2) Date: Sep. 17, 2014

(87) PCT Pub. No.: WO2016/008172
PCT Pub. Date: Jan. 21, 2016

(65) Prior Publication Data

US 2016/0260393 A1 Sep. 8, 2016

(30) Foreign Application Priority Data

Jul. 17, 2014 (CN) ..... 2014 1 0342004

(51) Int. Cl.
*G09G 3/36* (2006.01)
*G09G 5/02* (2006.01)

(52) U.S. Cl.
CPC ..... *G09G 3/3607* (2013.01); *G09G 3/3674* (2013.01); *G09G 3/3685* (2013.01);
(Continued)

(58) Field of Classification Search
CPC ..... G06G 3/3607; G06G 3/36; G06G 3/3674; G06G 3/3685; G06G 5/02;
(Continued)

(56) References Cited

U.S. PATENT DOCUMENTS 7,277,075 B1 * 10/2007 Hirano ..... G09G 3/3607 345/690
9,093,018 B2 * 7/2015 Tsuchiya ..... G09G 3/2011
(Continued)

FOREIGN PATENT DOCUMENTS

CN 1987987 A 6/2007

*Primary Examiner* — Ariel Balaoing
(74) *Attorney, Agent, or Firm* — Andrew C. Cheng

(57) ABSTRACT

A liquid crystal device is disclosed. The liquid crystal device includes a four-color converter, a data driver configured to process the RGBW information to be displayed to generate a simulated data signals, a scanning driver configured to generate scanning signals in sequence, and a display panel configured to display colors in accordance with the simulated data signals from the data driver and the scanning signals from the scanning driver. The four-color converter is configured to convert original RGB information to grayscale values for each color, to apply a white-balance process to the grayscale values for each color, to determine a maximum grayscale value and a minimum grayscale value among the grayscale values after the white-balance process, to generate two chromaticity values of a standard white color when the maximum grayscale value is not greater than a predetermined grayscale value, to calculate second grayscale values for each color in accordance with the two chromaticity values, to convert the minimum grayscale value to an outputted grayscale value of the white color to be displayed in the RGBW information, to calculate the outputted grayscale values for a red color, a green color, and a blue color within the RGBW information to be displayed in accordance
(Continued)

with the second grayscale values and the outputted grayscale value of the white color.

5 Claims, 3 Drawing Sheets

(52) U.S. Cl.
CPC ..... *G09G 5/02* (2013.01); *G09G 2300/0452* (2013.01); *G09G 2310/0213* (2013.01); *G09G 2340/06* (2013.01); *G09G 2360/16* (2013.01)

(58) Field of Classification Search
CPC ..... G06G 2310/0213; G09G 3/3607; G09G 3/36; G09G 3/3674; G09G 3/3685; G09G 5/02; G09G 2310/0213
See application file for complete search history.

(56) References Cited

U.S. PATENT DOCUMENTS

2007/0159492 A1* 7/2007 Lo ..... G09G 5/026 345/589
2008/0252653 A1* 10/2008 Alessi ..... G09G 3/3208 345/589
2013/0314436 A1* 11/2013 Nakamura ..... G09G 5/06 345/601
2014/0306983 A1* 10/2014 Park ..... G06T 7/408 345/590
2016/0019851 A1* 1/2016 Chen ..... G09G 3/3607 345/89

* cited by examiner

LIQUID CRYSTAL DEVICE AND THE DRIVING METHOD THEREOF

BACKGROUND OF THE INVENTION

1. Field of the Invention

The present disclosure relates to liquid crystal display technology, and more particularly to a liquid crystal device (LCD) and the driving method thereof.

2. Discussion of the Related Art

LCDs are characterized by attributes such as thinner, power-saving, low radiation, and the emitted soft lights are not harm to human eyes, and thus are widely adopted. The LCD mainly includes a liquid crystal panel and a backlight module opposite to the liquid crystal panel. In addition, the backlight module provides a light source for the liquid crystal panel such that the liquid crystal panel can display images via the light beams emitted from the light source.

Currently, most of liquid crystal displays (LCDs) or organic light emitting diode (OLED) displays include at least one pixel cell having a red (R) subpixel, a green (G) subpixel and a blue (B) subpixel. The grayscale values of each of the subpixels are controlled so as to mix the displayed color of one colorful image. With the development of the information technology, a great variety of demands toward display panels come out recently, such as high transmission rate, low power consumption, and high display performance. As the transmission rate and the mixing efficiency of the above RGB color-mixing method is relatively low, the power consumption of the display panel is high, which slows down the panel enhancement. In view of the above, a new pixel cell having the R subpixel, a G subpixel, a B subpixel, and a fourth subpixel has been developed so as to enhance the display performance of the RGB display panel.

Normally, the fourth subpixel is the white (W) subpixel. The advantage of the RGBW four-pixel-display includes: (1) the resolution of the subpixel is increased by the ratio of 1/4; (2) the transmission rate of the subpixel is increased by at least 50 percent; (3) the number of colors of RGBW is greater than that of the RGB for 11/16.

U.S. Pat. No. 7,277,075 B1 discloses a liquid crystal device having RGBW subpixels. The liquid crystal device obtains the RGB information from an inputted image signals. The RGB information includes output values respectively for white (Wo), for red (Ro), for green (Go) and for blue (Bo). The output values of the liquid crystal device satisfy the equation below:

$$Ri:Gi:Bi=(Ro+Wo):(Go+Wo):(Bo+Wo);$$

Wherein Ri, Gi, and Bi respectively represents the input value for red, green, and blue within the converted RGB information.

However, when the liquid crystal device displays the white color, the proportions of the first chromaticity value (x) and the second chromaticity value (y) forming the white color is a fixed value when the grayscale values is greater than a threshold grayscale value, such as the grayscale value in FIG. 1 as indicated by "M." When the grayscale value is not greater than the threshold grayscale value, the proportions of the first chromaticity value (x) and the second chromaticity value (y) of the white color are different. For this reason, the outputted values for each color calculated by the above equations may be not precise enough when the grayscale value is not greater than the threshold grayscale value.

SUMMARY

In one aspect, a liquid crystal device includes: a four-color converter configured to convert original RGB information to grayscale values for each color, to apply a white-balance process to the grayscale values for each color, to determine a maximum grayscale value and a minimum grayscale value among the grayscale values after the white-balance process, to generate a first chromaticity value (x) and a second chromaticity value (y) of a standard white color when the largest grayscale is not greater than a predetermined grayscale value, to calculate second grayscale values for each color in accordance with the first chromaticity value (x) and the second chromaticity value (y), to convert the minimum grayscale value to an outputted grayscale value of the white color to be displayed in the RGBW information, to calculate the outputted grayscale values for a red color, a green color, and a blue color within the RGBW information to be displayed in accordance with the second grayscale values and the outputted grayscale value of the white color, wherein the colors comprises the red color, the green color and the blue color, wherein Ri':Gi':Bi'=(Ro+Wo):(Go+Wo):(Bo+Wo), wherein Ri', Gi', and Bi' respectively represent the second grayscale values for the red color, the green color, and the blue color, wherein Ro, Go, Bo, and Wo respectively represents the output grayscale values for the red color, the green color, the blue color, and the white color; a data driver configured to process the RGBW information to be displayed to generate a simulated data signals, the RGBW information is received from the four-color converter; a scanning driver configured to generate scanning signals in sequence; and a display panel configured to display colors in accordance with the simulated data signals from the data driver and the scanning signals from the scanning driver.

Wherein the outputted grayscale values for the red color, the green color, and the blue color are calculated respectively by subtracting the outputted grayscale value of the white color from the second grayscale value of the respective color.

Wherein the four-color converter further configured to convert the minimum grayscale value to the outputted grayscale value of the white color of the RGBW information to be displayed when the minimum grayscale value is greater than the predetermined grayscale value, and to calculate the outputted grayscale values for the red color, the green color and the blue color within the RGBW information to be displayed in accordance with the grayscale values for each color after the white-balance process and the outputted grayscale value of the white color, wherein Ri:Gi:Bi=(Ro+Wo):(Go+Wo):(Bo+Wo), wherein Ri, Gi, and Bi respectively represents the grayscale values for the red color, the green color and the blue color after the white-balance process, and wherein Ro, Go, Bo, and Wo respectively represents the output grayscale values for the red color, the green color, the blue color, and the white color.

Wherein the outputted grayscale values for the red color, the green color, and the blue color are calculated respectively by subtracting the outputted grayscale value of the white color from the second grayscale value of the respective color after the white-balance process.

Wherein the four-color converter includes: a grayscale converting component configured to receive the original RGB information and to convert the original RGB information to grayscale values for each color; a white balance component configured to conduct the white-balance process to the grayscale values for each color so as to obtain the grayscale values for each color after the white-balance process; a comparing component configured to compare the grayscale values for each color to determine the maximum grayscale value and the minimum grayscale value; a determining component configured to determine whether the maximum grayscale value is greater than the predetermined grayscale value; a second grayscale value determining component configured to generate a first chromaticity value (x) and a second chromaticity value (y) of the standard white color upon determining the maximum grayscale value is not greater than the predetermined grayscale value, and to calculate the second grayscale values for each color in accordance with the first chromaticity value (x) and the second chromaticity value (y) of the standard white color, and the proportions of the first chromaticity value (x) and the second chromaticity value (y) are the same; a white color determining component configured to convert the minimum grayscale value to the outputted grayscale value of the white color to be displayed in the RGBW information; and a three color calculating component configured to calculate the outputted grayscale values for the red color, the green color and the blue color within the RGBW information to be displayed in accordance with the outputted grayscale values of the white color and the second grayscale values for each color.

Wherein the three color calculating component configured to calculate the outputted grayscale values for the red color, the green color and the blue color within the RGBW information to be displayed in accordance with the outputted grayscale values for the white color and the grayscale values for each color after the white-balance process upon determining the maximum grayscale value is greater than the predetermined grayscale values.

In another aspect, a driving method of a liquid crystal device includes: receiving the original RGB information and converting the original RGB information to grayscale values for each color, the colors comprising a red color, a green color and a blue color; applying a white-balance process to the grayscale values for each color to obtain the grayscale values for each color after the white-balance process; comparing the grayscale values for each color after the white-balance process to determine a maximum grayscale value and a minimum grayscale value; determining if the maximum grayscale value is greater than a predetermined grayscale value; generating a first chromaticity value (x) and a second chromaticity value (y) of a standard white color upon determining the maximum grayscale value is not greater than a predetermined grayscale value, and generating second grayscale values for each color according to the first chromaticity value (x) and the second chromaticity value (y); converting the minimum grayscale value to the outputted grayscale value of the white color of the RGBW information to be displayed; calculating the outputted grayscale values for the red color, the green color, and the blue color within the RGBW information to be displayed in accordance with the second grayscale values and the outputted grayscale value of the white color; and wherein Ri':Gi':Bi'=(Ro+Wo):(Go+Wo):(Bo+Wo), wherein Ri', Gi', and Bi' respectively represent the second grayscale values for the red color, the green color, and the blue color, wherein Ro, Go, Bo, and Wo respectively represents the output grayscale values for the red color, the green color, the blue color, and the white color.

Wherein the outputted grayscale values for the red color, the green color, and the blue color are calculated respectively by subtracting the outputted grayscale value of the white color from the second grayscale value of the respective color.

Wherein the method further includes: converting the minimum grayscale value to the outputted grayscale value of the white color of the RGBW information to be displayed when the minimum grayscale value is greater than the predetermined grayscale value; calculating the outputted grayscale values for the red color, the green color and the blue color within the RGBW information to be displayed in accordance with the grayscale values for each color after the white-balance process and the outputted grayscale value of the white color; and wherein Ri:Gi:Bi=(Ro+Wo):(Go+Wo):(Bo+Wo), wherein Ri, Gi, and Bi respectively represents the grayscale values for the red color, the green color and the blue color after the white-balance process, and wherein Ro, Go, Bo, and Wo respectively represents the output grayscale values for the red color, the green color, the blue color, and the white color.

Wherein the outputted grayscale values for the red color, the green color, and the blue color are calculated respectively by subtracting the outputted grayscale value of the white color from the second grayscale value of the respective color after the white-balance process.

The liquid crystal device and the driving method thereof are capable of keeping the proportions of the first chromaticity value and the second chromaticity value the same when the grayscale value is low. In addition, the precision regarding the output grayscale values for each color when the grayscale values are low is also enhanced.

DETAILED DESCRIPTION OF THE EMBODIMENTS

Embodiments of the invention will now be described more fully hereinafter with reference to the accompanying drawings, in which embodiments of the invention are shown. Various example embodiments will now be described more fully with reference to the accompanying drawings in which some example embodiments are shown. In the following description, in order to avoid the known structure and/or function unnecessary detailed description of the concept of the invention result in confusion, well-known structures may be omitted and/or functions described in unnecessary detail.

Figure 2:
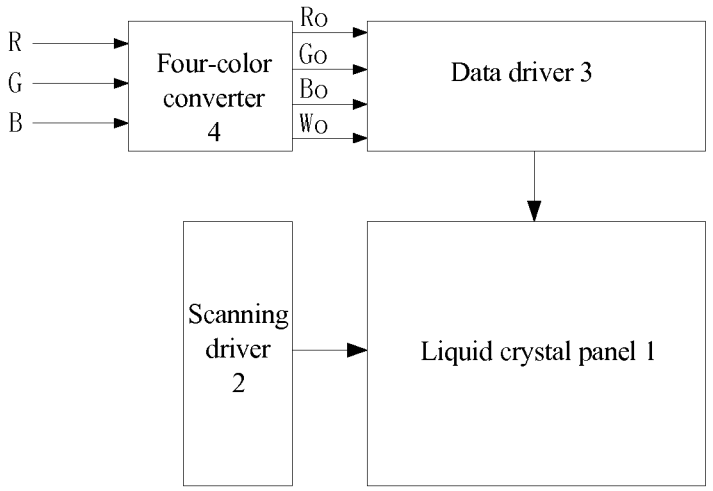
FIG. 2 is a block diagram of the liquid crystal device in accordance with one embodiment.
Figure 3:
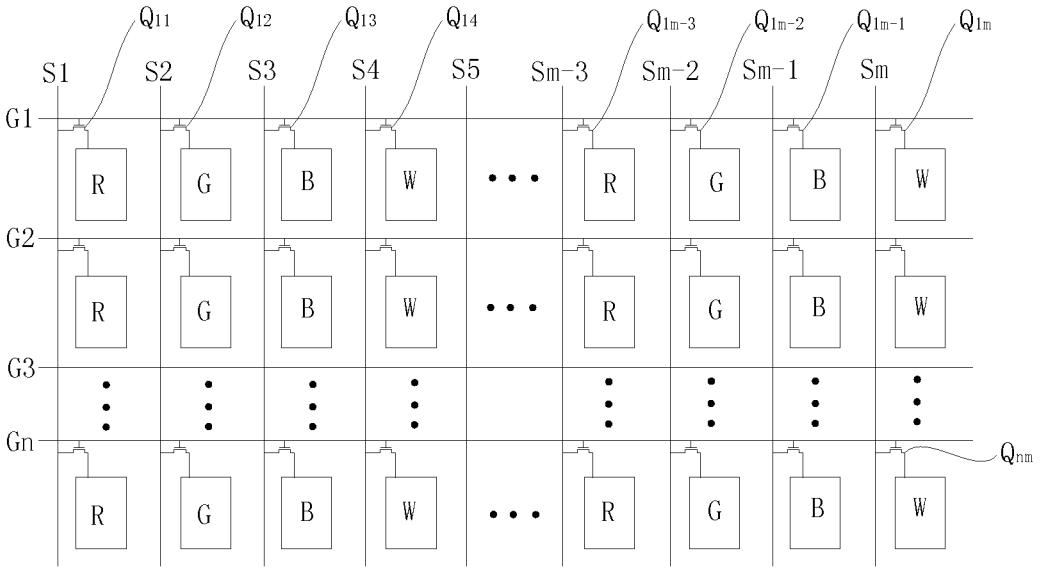
FIG. 3 is a schematic view showing the structure of the liquid crystal panel in accordance with one embodiment.
Figure 4:
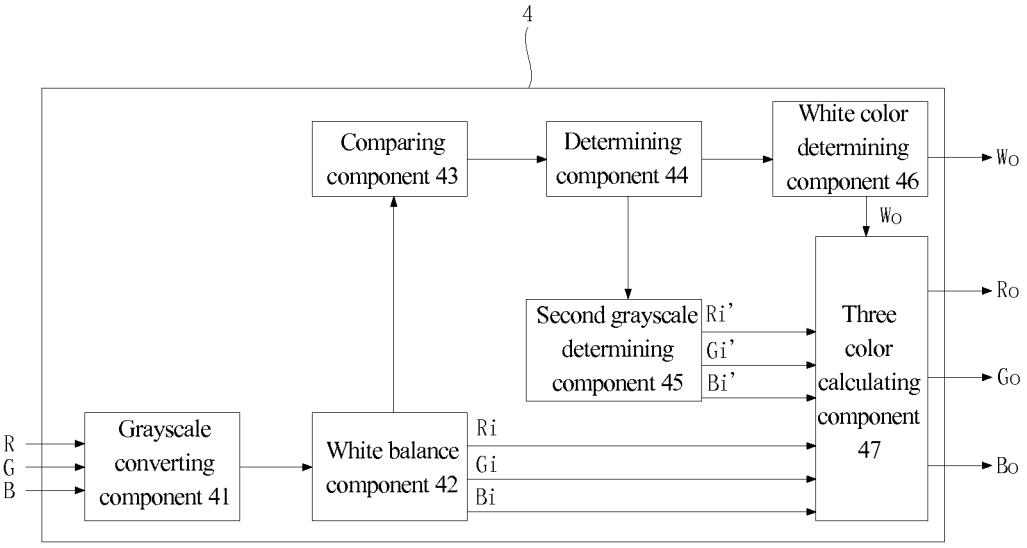
FIG. 4 is a block diagram of the four-color converter in accordance with one embodiment.

FIG. 2 is a block diagram of the LCD in accordance with one embodiment. FIG. 3 is a schematic view showing the structure of the liquid crystal panel in accordance with one embodiment. FIG. 4 is a block diagram of the four-color converter in accordance with one embodiment.

Referring to FIGS. 2 and 3, the liquid crystal panel 1 includes a plurality of scanning lines (G1-Gm) extending along a row direction and a plurality of data lines (S1-Sn), wherein m and n are natural numbers. The scanning lines (G1-Gm) connect to a scanning driver 2, and the data lines (S1-Sn) connect to the data driver 3.

Each R subpixels, G subpixels, B subpixels or W subpixels are arranged within each areas defined by the scanning lines (Gi) and (Gi+1) and data line (Sj) and (Sj+1), wherein i is in the range between 1 and m, and j is in the range between 1 and n. One R subpixel, one G subpixel, one B subpixel, and one W subpixel form one pixel.

Thin film transistors (TFTs) (Qij) are arranged in a proximity of each intersection of the scanning line (Gi) and the data line (Sj).

In addition, the scanning line (Gi) connects to a gate of the TFT (Qij), and the data line (Sj) connects to a source of the TFT (Qij). Pixel electrodes of each subpixels (R, G, B or W) respectively connects to drains of the corresponding TFT (Qij).

Common electrodes corresponding to the pixel electrode of each subpixels connect to a common voltage circuit (not shown).

The scanning driver 2 and the data driver 3 are arranged in a proximity of the liquid crystal panel 1. A four-color converter 4 connects to the data driver 3. The four-color converter 4 receives original RGB information and obtains the RGBW information to be displayed by the original RGB information. The original RGB information is provided by an external host or image controller (not shown). The data driver 3 receives the RGBW information from the four-color converter 4 and processes the RGBW information to generate a simulated data signals, such as a simulated voltage, to be provided to data lines (S1-Sn). The scanning driver 2 provides a plurality of scanning signals to the scanning lines (G1-Gn) in turn.

The four-color converter 4 includes a grayscale converting component 41, a white balance component 42, a comparing component 43, a determining component 44, a second grayscale value determining component 45, a white color determining component 46, and a three color calculating component 47.

The grayscale converting component 41 receives the original RGB information, and converts the original RGB information to grayscale values for each color, i.e., the grayscale values respectively for red (R), green (G), and blue (B).

The white balance component 42 receives the grayscale values for each color from the grayscale converting component 41, and then conducts a white-balance process to the grayscale values for each color. Ri, Gi, and Bi respectively represents the grayscale values for R, G and B after the white-balance process.

The comparing component 43 receives the grayscale values for each color after the white-balance process from the white balance component 42, and then compares the grayscale values for each color to determine the maximum one represented by MAX (Ri, Gi, Bi) and the minimum one represented by MIN (Ri, Gi, Bi).

The determining component 44 receives the MAX (Ri, Gi, Bi) from the comparing component 43, and determines whether the MAX (Ri, Gi, Bi) is greater than a predetermined grayscale value. For example, the predetermined grayscale value may be the grayscale threshold value in FIG. 1.

The second grayscale value determining component 45 determines whether or not to generate a first chromaticity value (x) and a second chromaticity value (y) according to a determining result of the determining component 44. In addition, the second grayscale value determining component 45 also determines whether or not to calculate second grayscale values for each color according to a standard first chromaticity value (x) and second chromaticity value (y). Under the circumstances that the maximum grayscale value is not greater than a predetermined range of the grayscale value, the proportions of the first chromaticity value (x) and the second chromaticity value (y) are the same. The second grayscale values for each color are different from the grayscale values for each color after the white-balance process. The second grayscale values indicate the grayscale values obtained from a standard white color mixed by all of the colors, and the proportions of the first chromaticity value (x) and of the second chromaticity value (y) for the standard white color are the same. When the determining component 44 determines the MAX (Ri, Gi, Bi) is not greater than the predetermined grayscale values, the second grayscale value determining component 45 generates the first chromaticity value (x) and the second chromaticity value (y) of the standard white color, and then calculates the second grayscale values for each color according to the first chromaticity value (x) and the second chromaticity value (y) of the standard white color.

When the determining component 44 determines the MAX (Ri, Gi, Bi) is not greater than the predetermined grayscale values, the second grayscale value determining component 45 generates the first chromaticity value (x) and the second chromaticity value (y) of the standard white color, and then calculates the second grayscale values for each color according to the first chromaticity value (x) and the second chromaticity value (y) of the standard white color. Wherein when the maximum grayscale value is not greater than a predetermined grayscale range, the proportions of the first chromaticity value (x) and of the second chromaticity value (y) for the standard white color are the same.

The second grayscale value determining component 45 calculates the second grayscale values for each color, including red (R), green (G), and blue (B), according to the first chromaticity value (x) and the second chromaticity value (y) for the standard white color.

The second grayscale values are calculated by equation 1 below.

$$\begin{bmatrix} Ri' \\ Gi' \\ Bi' \end{bmatrix} = M^{-1}\begin{bmatrix} X \\ Y \\ Z \end{bmatrix} = M^{-1}\begin{bmatrix} F1(\text{gray}) \\ F2(\text{gray}) \\ 1 - F1(\text{gray}) - F2(\text{gray}) \end{bmatrix} \quad \text{[Equation 1]}$$

Wherein, $X = x,$ $Y = y,$ $Z = 1 - x - y,$ $$M = \begin{bmatrix} S_rX_r & S_gX_g & S_bX_b \\ S_rY_r & S_gY_g & S_bY_b \\ S_rZ_r & S_gZ_g & S_bZ_b \end{bmatrix};$$

$x = F1(\text{gray}),$ $y = F2(\text{gray});$

Wherein "gray" represents the grayscale value for the standard white color, and "gray" is not greater than the predetermined grayscale value. F1 represents a fitting function for obtaining the first chromaticity value (x) of the standard white color by using the grayscale values (gray) of the standard white color. F2 represents the fitting function for obtaining the second chromaticity value (y) of the standard white color by using the grayscale values (gray) of the standard white color. In one example, the fitting functions F1 and F2 may be known fitting functions for respectively obtaining the first chromaticity value (x) and the second chromaticity value (y) by the grayscale value (gray) of the standard white color.

In the matrix M, $X_r=x_r/y_r$, $Y_r=1$, $Z_r=(1-X_r-y_r)/y_r$; $X_g=x_g/y_g$, $Y_g=1$, $Z_g=(1-x_g-y_g)/y_g$; $X_b=x_b/y_b$, $Y_b=1$, $Z_b=(1-x_b-y_b)/y_b$;

$$\begin{bmatrix} S_r \\ S_g \\ S_b \end{bmatrix} = \begin{bmatrix} X_r & X_g & Y_b \\ Y_r & Y_g & Y_b \\ Z_r & Z_g & Z_b \end{bmatrix}^{-1} \begin{bmatrix} X_w \\ Y_w \\ Z_w \end{bmatrix};$$

Wherein Xw, Yw and Zw represent the tristimulus values of standard white color obtained by measurement, $x_r$ and $y_r$ represents the chromaticity values of the R color, $x_g$ and $y_g$ represents the chromaticity values of the G color, and $x_b$ and $y_b$ represents the chromaticity values of the B color.

The white color determining component 46 receives the MIN (Ri, Gi, Bi) among the grayscale values for each color from the comparing component 43, and then converts the MIN (Ri, Gi, Bi) into an outputted grayscale value of the white color to be displayed in the RGBW information.

The three color calculating component 47 receives the outputted grayscale value of W color from the white color determining component 46, and calculates the outputted grayscale values for R, G, and B colors within the RGBW information. The outputted grayscale values for R, G, and B colors are calculated by the grayscale values for each color after the white-balance process from the white balance component 42 or by the second grayscale values for each color from the second grayscale value determining component 45 in accordance with the determining result.

When the determining component 44 determines the MAX (Ri, Gi, Bi) is not greater than the predetermined grayscale value, the three color calculating component 47 receives the outputted grayscale value for the W color from the white color determining component 46 and then receives the second grayscale values for each color from the second grayscale value determining component 45. The three color calculating component 47 calculates the outputted grayscale values for R, G, and B colors by Equation 2 below.

$$Ro=Ri'-Wo;$$

$$Go=Gi'-Wo;$$

$$Bo=Bi'-Wo; \qquad \text{[Equation 2]}$$

Wherein Ro, Go, Bo, and Wo respectively represents the output grayscale values for R color, G color, B color, and W colors within the RGBW information. The Ri', Gi', and Bi' respectively represents the second grayscale values for R color, G color, and B color.

As the MAX (Ri, Gi, Bi) is not greater than the predetermined grayscale values, the second grayscale value determining component 45 generates the first chromaticity value (x) and the second chromaticity value (y) for standard white color with the same proportion. The second grayscale values satisfies the equations: Ri':Gi':Bi'=(Ro+Wo):(Go+Wo):(Bo+Wo).

In this way, when the MAX (Ri, Gi, Bi) is not greater than the predetermined grayscale values, the grayscale values for each color after the white-balance are converted into the second grayscale values for each color such that the white color mixed by each color conforms to the standard white color. In addition, the proportions of the first chromaticity value (x) and of the second chromaticity value (y) are the same. Also the second grayscale values for each color satisfy the equation: Ri':Gi':Bi'=(Ro+Wo):(Go+Wo):(Bo+Wo). As such, the precision of the outputted grayscale values for each color is enhanced.

If the determining component 44 determines that the MAX (Ri, Gi, Bi) is greater than the predetermined grayscale values, the three color calculating component 47 receives the outputted grayscale values for W color from the white color determining component 46, and receives the grayscale values for each color after the white-balance process from the white balance component 42. The three color calculating component 47 calculates the outputted grayscale values for R color, G color, and B color by Equation 3.

$$Ro=Ri-Wo$$

$$Go=Gi-Wo$$

$$Bo=Bi-Wo \qquad \text{[Equation 3]}$$

Wherein Ro, Go, Bo, and Wo respectively represents the outputted grayscale values for R, G, B, and W colors within the RGBW information.

In this way, when the MAX (Ri, Gi, Bi) is greater than the predetermined grayscale values, the grayscale values for each color after the white-balance process satisfy the equation below:

$$Ri:Gi:Bi=(Ro+Wo):(Go+Wo):(Bo+Wo);$$

Figure 5:
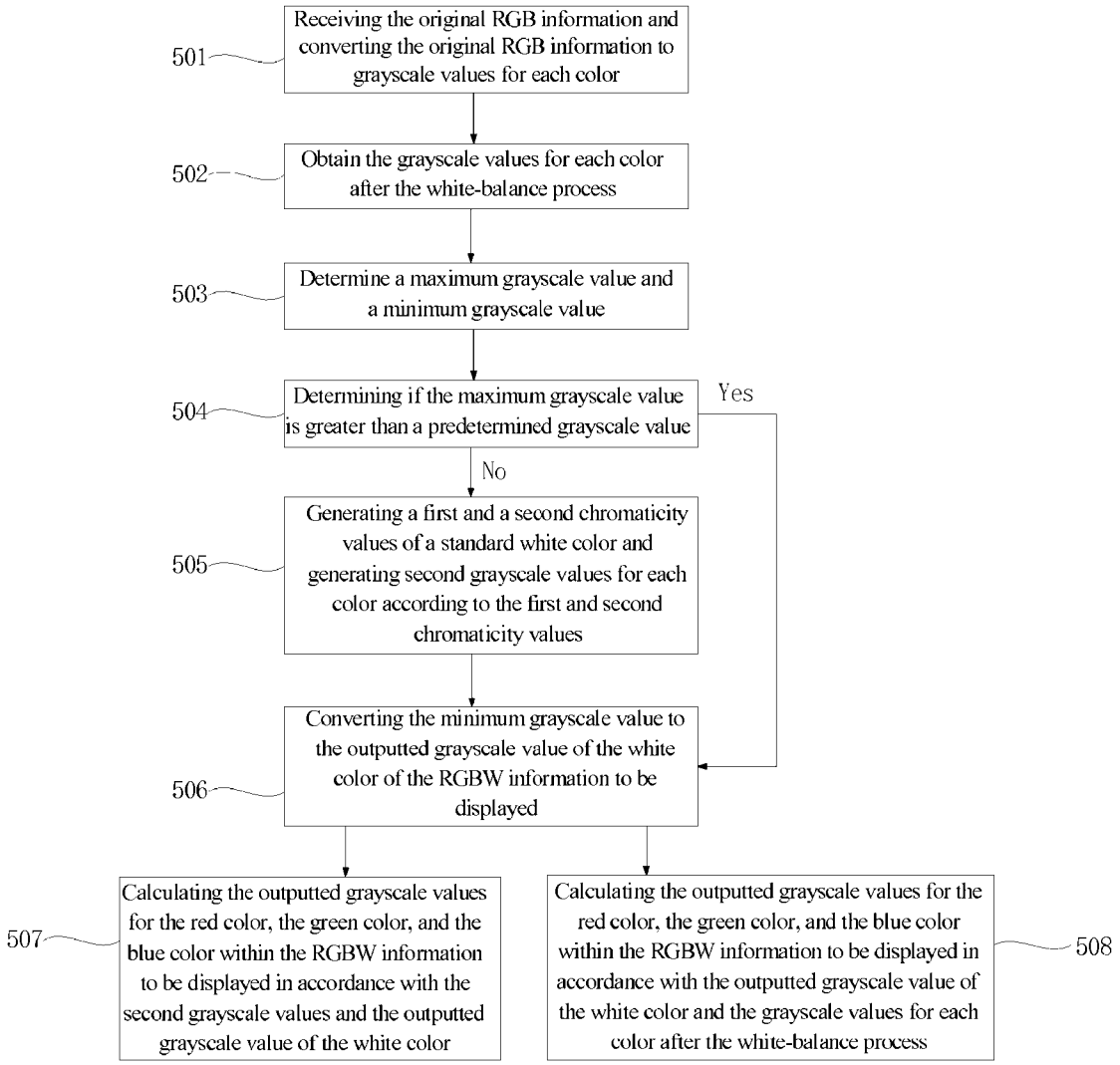
FIG. 5 is a flowchart of the driving method for the liquid crystal device in accordance with one embodiment.

FIG. 5 is a flowchart of the driving method for the liquid crystal device in accordance with one embodiment.

In step 501, the original RGB information is received and converted to the grayscale values for each color, including red (R), green (G), and blue (B).

In step 502, the grayscale values for each color are received and are applied with the white-balance process so as to obtain the grayscale values for each color after the white-balance process. Ri, Gi, and Bi respectively represents the grayscale values for R color, G color, and B blue after the white-balance process.

In step 503, the grayscale values for each color after the white-balance process are received and then compared so as to determine the maximum one and the minimum one. The maximum one is represented by MAX (Ri, Gi, Bi), and the minimum one is represented by MIN (Ri, Gi, Bi).

Figure 1:
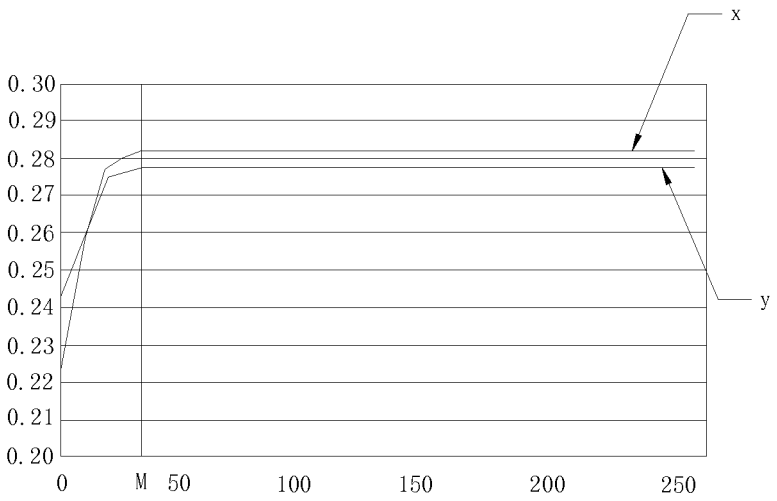
Fig. 1 (Prior Art)
FIG. 1 is a chart showing the relationship between the chromaticity value and grayscale value of the white color displayed by one conventional LCD.

In step 504, the MAX (Ri, Gi, Bi) is received and is compared with one predetermined grayscale value, i.e., the threshold grayscale values in FIG. 1. If the MAX (Ri, Gi, Bi) is not greater than the predetermined grayscale value, the process goes to steps 505, 506, and 507. If the MAX (Ri, Gi, Bi) is greater than the predetermined grayscale value, the process goes to steps 506 and 508.

In step 505, the first chromaticity value (x) and the second chromaticity value (y) of the standard white color are generated. Also the second grayscale values for each color are obtained by the first chromaticity value (x) and the second chromaticity value (y) of the standard white color. The proportions of the first chromaticity value (x) and the second chromaticity value (y) are the same when the maximum grayscale value is not greater than the predetermined grayscale values range. In addition, the second grayscale values for each color are different from the grayscale values for each color after the white-balance process. The second grayscale values for each color indicate the grayscale values obtained from the standard white color mixed by all of the colors, and the proportions of the first chromaticity value (x) and the second chromaticity value (y) for the standard white color are the same. The second grayscale values for each color include the second grayscale values for R color, G color, and B color.

In step 505, the second grayscale values for each color are calculated by Equation 1.

In step 506, the MIN (Ri, Gi, Bi) among the grayscale values for each color is received and converted into the outputted grayscale values for white color within the RGBW information to be displayed.

In step 507, the outputted grayscale values for the white color and the second grayscale values for each color are received. The outputted grayscale values for R color, G color, and B color are calculated by Equation 2. As the MAX (Ri, Gi, Bi) is not greater than the predetermined grayscale values, the proportions of the first chromaticity value (x) and the second chromaticity value (y) are the same. Thus, the second grayscale values for each color satisfy the relationship: Ri':Gi':Bi'=(Ro+Wo):(Go+Wo):(Bo+Wo). Wherein Ri', Gi', and Bi' respectively represent the second grayscale values for R color, G color, and B color.

In this way, when the MAX (Ri, Gi, Bi) is not greater than the predetermined grayscale values, the grayscale values for each color after the white-balance are converted into the second grayscale values for each color such that the white color mixed by each color conforms to the standard white color. In addition, the proportions of the first chromaticity value (x) and of the second chromaticity value (y) are the same. Also the second grayscale values for each color satisfy the equation: Ri':Gi':Bi'=(Ro+Wo):(Go+Wo):(Bo+Wo).

In step 508, the outputted grayscale values for the W color and the grayscale values for each color after the white-balance process are received, and the outputted grayscale values for the R color, G color and B color are calculated by Equation 3.

In this way, when the MAX (Ri, Gi, Bi) is greater than the predetermined grayscale values, the grayscale values for each color after the white-balance process satisfy the equation: Ri:Gi:Bi=(Ro+Wo):(Go+Wo):(Bo+Wo).

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal device, comprising:

a four-color converter configured to convert original RGB information to grayscale values for each color, to apply a white-balance process to the grayscale values for each color, to determine a maximum grayscale value and a minimum grayscale value among the grayscale values after the white-balance process, to generate a first chromaticity value (x) and a second chromaticity value (y) of a standard white color when the largest grayscale is not greater than a predetermined grayscale value, to calculate second grayscale values for each color in accordance with the first chromaticity value (x) and the second chromaticity value (y), to convert the minimum grayscale value to an outputted grayscale value of the white color to be displayed in the RGBW information, to calculate the outputted grayscale values for a red color, a green color, and a blue color within the RGBW information to be displayed in accordance with the second grayscale values and the outputted grayscale value of the white color, wherein the colors comprises the red color, the green color and the blue color, wherein Ri':Gi':Bi'=(Ro+Wo):(Go+Wo):(Bo+Wo), wherein Ri', Gi', and Bi' respectively represent the second grayscale values for the red color, the green color, and the blue color, wherein Ro, Go, Bo, and Wo respectively represents the output grayscale values for the red color, the green color, the blue color, and the white color;

a data driver configured to process the RGBW information to be displayed to generate a simulated data signals, the RGBW information is received from the four-color converter;

a scanning driver configured to generate scanning signals in sequence;

a display panel configured to display colors in accordance with the simulated data signals from the data driver and the scanning signals from the scanning driver; and wherein the four-color converter comprises:

a grayscale converting component configured to receive the original RGB information and to convert the original RGB information to grayscale values for each color;

a white balance component configured to conduct the white-balance process to the grayscale values for each color so as to obtain the grayscale values for each color after the white-balance process;

a comparing component configured to compare the grayscale values for each color to determine the maximum grayscale value and the minimum grayscale value;

a determining component configured to determine whether the maximum grayscale value is greater than the predetermined grayscale value;

a second grayscale value determining component configured to generate a first chromaticity value (x) and a second chromaticity value (y) of the standard white color upon determining the maximum grayscale value is not greater than the predetermined grayscale value, and to calculate the second grayscale values for each color in accordance with the first chromaticity value (x) and the second chromaticity value (y) of the standard white color, and the proportions of the first chromaticity value (x) and the second chromaticity value (y) are the same;

a white color determining component configured to convert the minimum grayscale value to the outputted grayscale value of the white color to be displayed in the RGBW information; and a three color calculating component configured to calculate the outputted grayscale values for the red color, the green color and the blue color within the RGBW information to be displayed in accordance with the outputted grayscale values of the white color and the second grayscale values for each color.

2. The liquid crystal device as claimed in claim 1, wherein the outputted grayscale values for the red color, the green color, and the blue color are calculated respectively by subtracting the outputted grayscale value of the white color from the second grayscale value of the respective color.

3. The liquid crystal device as claimed in claim 1, wherein the four-color converter further configured to convert the minimum grayscale value to the outputted grayscale value of the white color of the RGBW information to be displayed when the minimum grayscale value is greater than the predetermined grayscale value, and to calculate the outputted grayscale values for the red color, the green color and the blue color within the RGBW information to be displayed in accordance with the grayscale values for each color after the white-balance process and the outputted grayscale value of the white color, wherein Ri:Gi:Bi=(Ro+Wo):(Go+Wo):(Bo+Wo), wherein Ri, Gi, and Bi respectively represents the grayscale values for the red color, the green color and the blue color after the white-balance process, and wherein Ro, Go, Bo, and Wo respectively represents the output grayscale values for the red color, the green color, the blue color, and the white color.

4. The liquid crystal device as claimed in claim 3, wherein the outputted grayscale values for the red color, the green color, and the blue color are calculated respectively by subtracting the outputted grayscale value of the white color from the second grayscale value of the respective color after the white-balance process.

5. The liquid crystal device as claimed in claim 1, wherein the three color calculating component configured to calculate the outputted grayscale values for the red color, the green color and the blue color within the RGBW information to be displayed in accordance with the outputted grayscale values for the white color and the grayscale values for each color after the white-balance process upon determining the maximum grayscale value is greater than the predetermined grayscale values.

* * * * *